United States Patent [19]

Pfarrwaller

[11] 3,971,522

[45] July 27, 1976

[54] APPARATUS FOR STORAGE OF FILAMENTARY MATERIAL

[75] Inventor: Erwin Pfarrwaller, Winterthur, Switzerland

[73] Assignee: Sulzer Brothers Limited, Winterthur, Switzerland

[22] Filed: Sept. 20, 1974

[21] Appl. No.: 507,948

[30] Foreign Application Priority Data

Sept. 25, 1973 Switzerland ..... 13702/73

[52] U.S. Cl. ..... 242/47.01; 242/47.05; 242/47.12

[51] Int. Cl.[2] ..... B65H 51/20

[58] Field of Search ..... 242/47.01, 47.04, 47.05, 242/47.06, 47.07, 47.12, 47.13; 66/132 R; 139/122 R

[56] References Cited

UNITED STATES PATENTS

| | | | |
|---|---|---|---|
| 2,387,252 | 10/1945 | Furness | 242/47.05 |
| 2,425,136 | 8/1947 | Torrence | 242/47.05 |
| 2,431,712 | 12/1947 | Stanley | 242/47.07 |
| 3,411,548 | 11/1968 | Pfarrwaller | 242/47.12 X |
| 3,759,300 | 9/1973 | Pfarrwaller | 242/47.12 X |
| 3,761,031 | 9/1973 | Pfarrwaller | 242/47.01 |
| 3,776,480 | 12/1973 | Lawson | 242/47.01 |
| 3,796,386 | 3/1974 | Tannert | 242/47.12 |
| 3,822,833 | 7/1974 | Fecker | 242/47.12 |

*Primary Examiner*—Stanley N. Gilreath
*Attorney, Agent, or Firm*—Pennie & Edmonds

[57] ABSTRACT

For uses such as the intermediate storage of weft thread in gripper shuttle looms, a storage apparatus comprises a drum mounted on the end of a hollow rotating shaft, the drum being held stationary by magnets, and a shaft carrying a flyer by means of which a thread passing down the shaft can be laid on to the drum. A toothed wheel is also rotatably mounted on the shaft, on an axis however skewed to the axis of the drum. The wheel has teeth which engage in slots in the drum. The teeth have, in the region of the drum height at which the thread is laid on, a portion extending axially of the toothed wheel and they have between that region and the free end of the drum a further portion extending obliquely toward the axis of the toothed wheel.

7 Claims, 9 Drawing Figures

APPARATUS FOR STORAGE OF FILAMENTARY MATERIAL

The present invention relates to reeling apparatus for the storage of filamentary material, and more particularly to apparatus for the formation of a multi-turn coil of filamentary material on a drum supported from one end so that the material can be pulled off axially over the other, "free" end of the drum. Such apparatus is useful in the supply of thread to the shuttles in gripper shuttle looms. In such looms each weft thread is pulled through the shed of warp threads by a shuttle shot from the picking to the catching side of the loom. Such looms may be contrasted, for present purposes, with looms in which the shuttles carry a pirn of thread which unwinds or unravels as the shuttle moves through the shed.

The present invention provides improved apparatus of this character, capable of forming on the drum a single-layer coil having a large number of turns. The improved apparatus of the invention can thus store a long length of thread, as is useful for example in the operation of gripper shuttle looms weaving wide cloth.

Apparatus of the type to which the invention relates is sometimes known as intermediate weft thread storage apparatus.

Such apparatus has been heretofore proposed, as in U.S. Pat. Nos. 3,411,548, 3,759,300 and 3,761,031, in which a weft thread passes down a hollow rotating shaft and out through a flyer arm attached to the shaft. Rotation of the shaft and flyer arm lays the thread onto a drum rotatably supported on the free end of the shaft but restrained by magnets against rotation. The turns so laid down accumulate into a coil and the drum may be sloped so that newly laid down turns push the previous turns toward the free end of the drum. The result is that a substantially single layer coil is formed. When such apparatus is used with a gripper shuttle loom, at each pick a gripper shuttle is sent through the shed of the loom and pulls a number of turns off the free end of the drum. Photoelectric mechanism responsive to the axial length of the coil may be coupled to the drive to the hollow shaft so as to hold the axial length of the coil, i.e., the number of turns therein, between minimum and maximum values.

Other forms of intermediate weft thread storage apparatus have been proposed in which the drum is rotated by a motor and thereby winds the turns of the thread onto itself from a fixed tangential direction, as in the operation of a capstan. The drum is supported from one end only so that the yarn can be pulled off over the other free end for insertion into the shed of a loom. In one such apparatus, disclosed in U.S. Pat. No. 3,131,729, the drum takes the form of a set of four endless belts, one in each of four planes containing the axis of rotation of the drum and spaced 90° apart about the axis. A worm gear drive to these belts causes the outer runs thereof to move slowly toward the free end of the drum and in this way the turns laid down on the drum by the flyer are caused to form a single layer coil.

In a particular form of apparatus of this last type described in British Pat. No. 977,936 the drum, supported on a stationary shaft and driven by belts from a motor, takes the form of a set of axially extending bars, as in a squirrel cage. This drum is supplemented by a second similar drum, of the same length and diameter, the bars of which are engaged, with clearance, between adjacent bars of the first drum. The second drum is supported on bearings from the stationary shaft which supports the first drum, but for rotation about an axis skew to the axis of the first drum, and with moreover the point of closest approach of the skew axes at or near the end of the first drum at which the yarn is wound on from a stationary eye.

The result is that as the drums rotate, the individual portions of each turn of thread coiled on the two almost but not quite coaxial drums are alternately and successfully carried by bars of one drum and then of the other, and the skew orientation of the two axes produces step-by-step shifting of these turns toward the free end of the two drums. By analogy to swash plate pumps, as illustrated for example in FIG. 24 at page 14–15 of Baumeister & Marks, Standard Handbood For Mechanical Engineers, 7th edition, McGraw-Hill, New York 1966, the second drum may also be termed a swash member.

In operation however the construction of British Pat. No. 977,936 just described has the disadvantage that the axial length over which a single layer coil can be accumulated, and hence the thread capacity of the intermediate weft thread storage device, is undesirably limited. This limitation arises from the fact that with progression toward the free end of the drums, the bars or ribs of the skew drum or swash member protrude more and more outwardly from beneath the bars of the first drum. This means that the axial shift per revolution of the drums imposed upon the turns of thread already wound on varies with the position of those turns lengthwise of the drums, increasing toward their free end. The result is that the single layer coil has its turns closely spaced at the winding-on end of the drums but has them more and more widely spaced as one approaches the free end of the drums.

The invention provides an intermediate weft thread storage apparatus of the general character disclosed in the applicant's U.S. Pat. No. 3,761,031, incorporating however two drums on skew axes as in British Pat. No. 977,936, but improved in respect of the shortcoming of the apparatus of that British Pat. No. 977,936 just described. In accordance with the invention the second drum is dimensioned to be operative only over a portion of the axial length of the first drum adjacent the laying-on end thereof. The second drum, which may perhaps better be described as a toothed wheel, moreover has its ribs or bars, i.e. its teeth, so shaped as to include a first generally axially extending portion for axial shift of newly laid on turns and in addition an inclined portion by means of which previously laid down turns are pushed axially, but by a diminished amount. By this construction there is achieved a single layer coil of which the oldest turns (those nearing the free end of the drum) have substantially the same axial spacing or packing as do the newest turns. The result is, effectively, a longer useful axial length for the coil and a greater thread storage capacity. The apparatus of the invention in practice produces a single layer coil the turns of which are in contact with each other, the oldest portion of the coil being out of range of the second drum entirely and being further progressively axially shifted toward the free end by push applied by the newly laid turns as they are axially shifted by the oblique portions of the teeth of the second drum.

On the other hand, the advantages of the swash member of British Pat. No. 977,936 are retained. This means that the thread can be fed onto the drums in a substantially tension free state so that it is not subjected to any special stress during the winding on. The axial advancing force for the closely packed turns of the oldest part of the coil, which are advanced axially as a unit, need not be supplied by the newly arriving turn. Moreover, as with the apparatus of the British patent, the otherwise customary thread brake upsteam of the apparatus, between it and the supply spool of weft thread, may be dispensed with.

BRIEF DESCRIPTION OF THE DRAWING

The invention will now be further described in terms of a presently preferred exemplary embodiment thereof and with reference to the accompanying drawing in which.

DESCRIPTION OF PREFERRED EMBODIMENT

Figure 1:
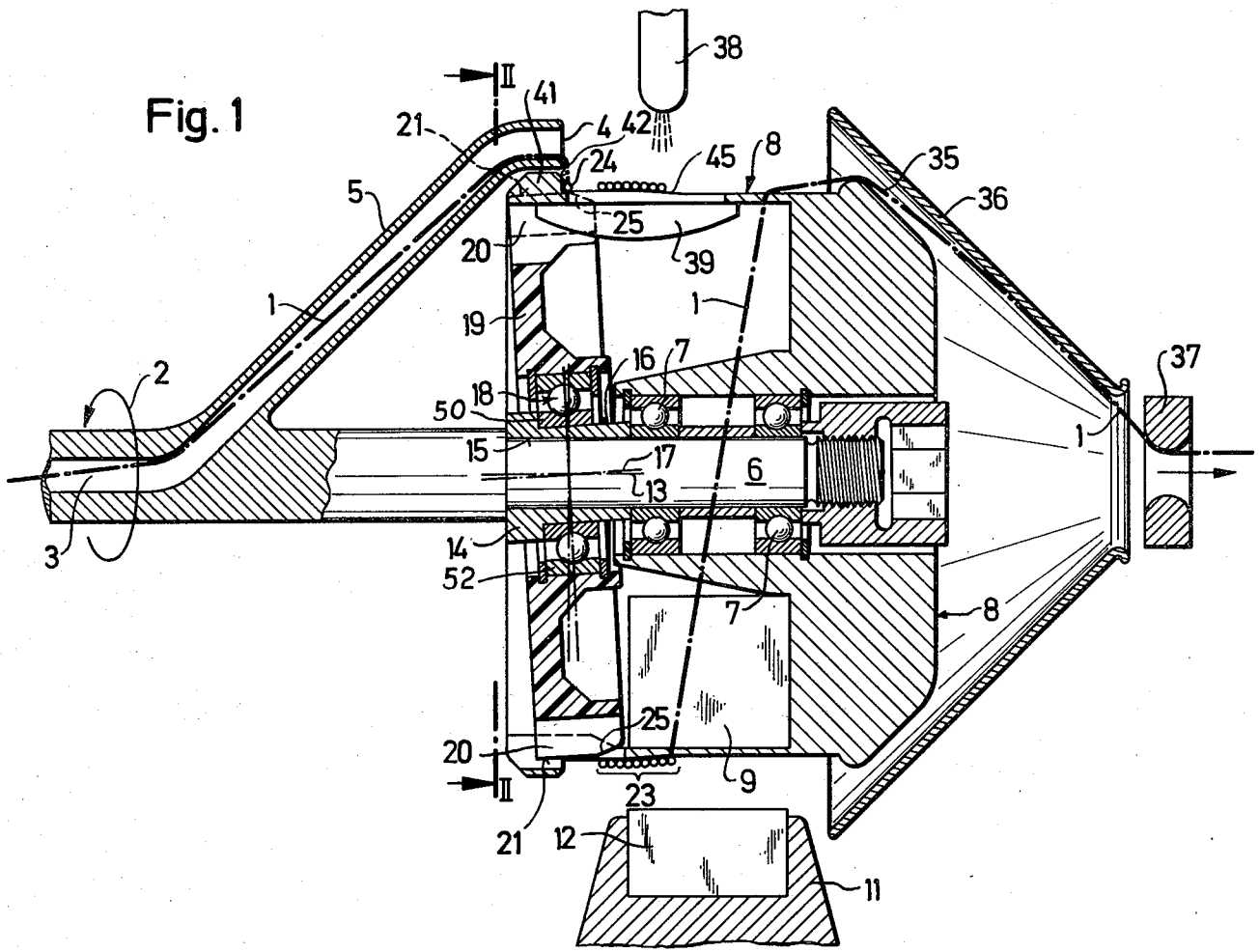
FIG. 1 is a vertical axial sectional view through a thread storage apparatus according to the invention.

Referring to FIG. 1, reference character 3 identifies a shaft, hollow at the left end and supported in bearings, not shown, for rotation with respect to a stationary base, fragmentarily shown at 11. A motor, likewise not shown, is coupled through a clutch to the shaft 3 to impart controllable rotation thereto. Apparatus of this character is disclosed in U.S. Pat. No. 3,411,548 which is assigned to the assignee hereof. Affixed to the shaft 3 is a flyer arm 5 ending in an eye 4. A weft thread or yarn 1 indicated in chain lines in FIG. 1 thus passes from a store such as a spool or package, not shown, to the right in FIG. 1 through the shaft 3 and out through the flyer arm 5, from which it is laid onto the drum 8 as more fully described below.

The shaft 3 terminates in a stub 6 at the right of the flyer arm 5, and a generally cylindrical winding drum 8 is supported from the stub shaft 6 by means of bearing 7. The drum 8 is restrained from rotation by the action of a permanent magnet 9 in the drum cooperating with a permanent magnet 12 stationarily mounted in the machine frame 11.

On the stub shaft 6 there is moreover affixed a sleeve 14 between the flyer arm 5 and the drum 8. The sleeve 14 supports a ball bearing generally indicated at 18. The inner race 50 of this ball bearing is supported on the outer cylindrical surface 16 of the sleeve 14 and the outer race 52 of the ball bearing supports a "swash member" in the form of a toothed wheel 19. The outer surface 16 of the sleeve 14 is eccentric and is moreover inclined to the inner surface 15 of that sleeve. Hence the axis 17 of the surface 16, which is also the axis of rotation of the wheel 19, is therefore skew to the axis of rotation 13 of the shaft 3. 13 is also the axis of relative rotation of the drum 8 and shaft 3.

Figure 2:
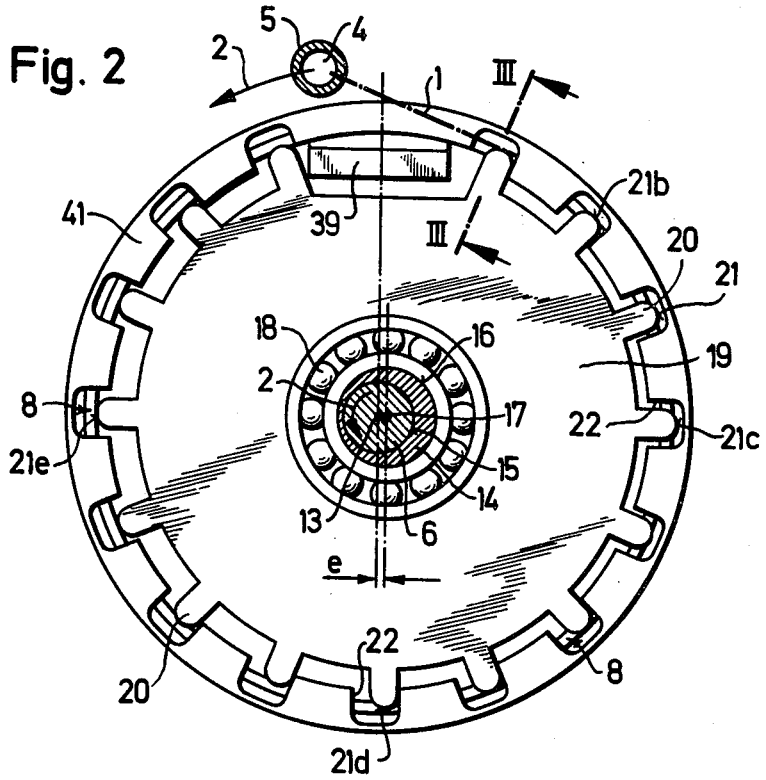
FIG. 2 is a sectional view in elevation taken on the line II—II in FIG. 1.

The minimum separation of the axes 13 and 17, along the unique line perpendicular to them both, is indicated by the dimension *e* in FIG. 2. In FIG. 1 the separation *e* is perpendicular to the plane of the figure. Hence the projections of the axes 13 and 17 onto the plane of that figure possess a larger angular separation than do the projections of those skew axes onto any other plane.

Figure 4:
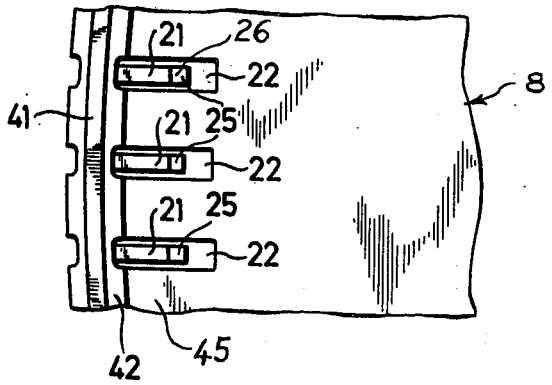
FIG. 4 is a fragmentary developed view, looking radially inwardly, of the outer surface of the drum and toothed wheel in the apparatus of FIG. 1.
Figures 3, 3A:
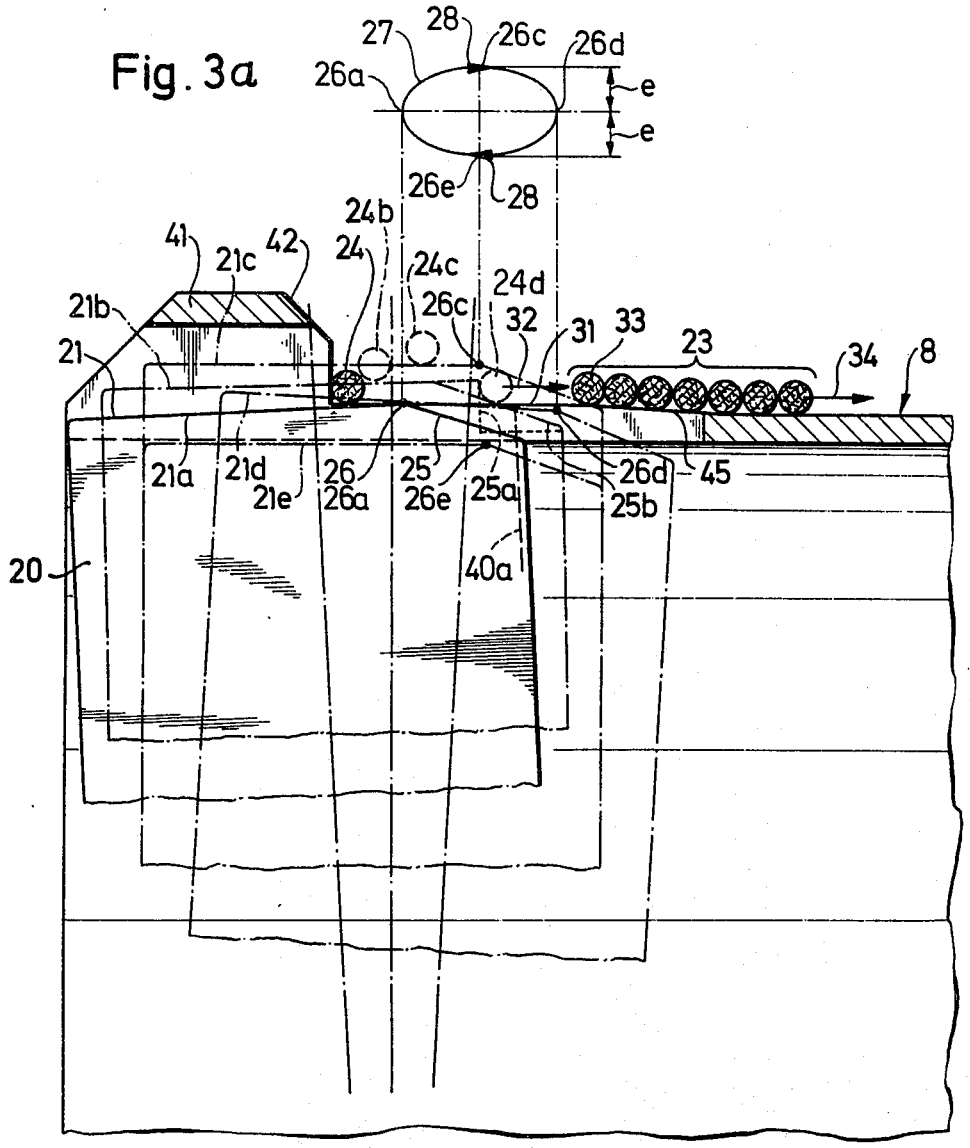
FIG. 3 is a fragmentary axial sectional view taken on the line III—III of FIG. 2 but shown at an enlarged scale, and including moreover in chain lines a showing of successive positions for one of the teeth in the toothed wheel of the apparatus of FIGS. 1 and 2.
FIG. 3*a* is a diagram useful in explaining the operation of that apparatus in conjunction with FIG. 3.

As illustrated in FIGS. 2 and 3, wheel 19 is provided about its periphery with a set of teeth 20 which engage with clearance in slots 22 which extend through the drum 8, but which are of short axial extent compared to the axial length of the drum, as may be seen in FIG. 4. The teeth 20 protrude through the slots 22 radially out beyond the surface of the drum in a manner more particularly described hereinafter. By interengagement of the teeth 20 and slots 22, the wheel 19 is restrained from rotation with respect to the drum and instead is caused by rotation of the eccentric 14, fixed to the shaft 6, to execute an oscillatory motion which is described below. The teeth 20 possess a shape illustrated in FIGS. 3 and 4. In the terminology of spur gears, as set forth for example in the McGraw-Hill Encyclopedia of Science and Technology, New York, 1960, Vol. 6, page 81, each tooth is peripherally bounded by a top land. This top land includes an essentially flat portion, shown at 21 in FIGS. 3 and 4, and, in a preferred embodiment illustrated in those figures, an oblique portion 25, extending generally toward the axis of the drum 8 at the free end thereof. The portions 21 may belong to a common circularly cylindrical surface coaxial of the wheel 19, and the portions 25 may belong to a common conical surface likewise coaxial of the wheel 19, generated by a cone of relatively large half angle, i.e. of the order of 20°. The surfaces 21 and 25 intersect at a circular arris indicated at 26 in FIG. 4. The trace of one such tooth 20 in an axial plane is shown in full lines in FIG. 3 where the reference characters 20, 21, 25 and 26 have been applied to the trace of that tooth.

By virtue of the skew mounting of the wheel 19 and drum 8 with respect to each other, the wheel undergoes a motion similar to that of an eccentric combined with a further rocking or wobbling motion similar to that of a swash plate. The effect is that with rotation of the shaft 3 each tooth is carried, for each rotation of that shaft, through an essentially elliptical motion as illustrated at the curve 27 in FIG. 3*a* for the arris 26 of the tooth 20. Successive teeth around the wheel 19 are moreover successively dephased with respect to each other in this elliptical motion. The motion carries each tooth above the peripheral surface 45 of the drum to lift off of the drum the portion of each turn of thread overlying the portion 21 of that tooth. It then shifts the tooth and hence those turn portions to the right in FIG. 3. It then lowers the tooth below the slot so as to redeposit those turn portions on the drum surface 45. It lastly returns to the tooth to its starting point. In the manner thus qualitatively described, the plate 19 shifts newly laid down turns of thread toward the free end of the drum 8. Portions of thread turns overlying the oblique, conical tooth portions 25 are moved axially a lesser distance on each cycle and there is built up, to the right of the teeth 20 and of the slots 22, a coil of contiguous turns as indicated at 23 in FIG. 3.

The drum 8 possesses in the embodiment illustrated, at its left end nearest the flyer arm 5, an uninterrupted circular, annular portion 41 of maximum diameter. This portion is bounded on the side toward the free end of the drum by a conical surface 42 of large cone angle. The surface 42 is followed by a surface 45 which may be cylindrical or may be conical with a very small half-angle of, say, from one to three degrees. The slots 22 are cut through the portion 45 of the drum periphery and indeed encroach on the minimum diameter portion of the conical surface 42, as illustrated in FIG. 4.

A combined light source and photoelectric detector is diagrammatically illustrated at 38 in FIG. 1. It cooperates with a reflector 39 disposed beneath a transparent window in the drum surface to control, in accordance with axial location of the right-hand limit of the coil 23, the drive to the shaft 3 in the manner already described.

Considering now FIG. 3 in greater detail, when the shaft 3 is in the angular position indicated in FIGS. 1 and 2 with the oblique axis 17 of the plate 19 in a vertical plane and with, consequently, the separation *e* of the axes 13 and 17 at their point of closest approach in a horizontal plane, the tooth 20 will occupy the position indicated in full lines therefor in FIG. 3 with its arris point 26 at the location additionally identified at 26*a* in FIG. 3. As the shaft 3 rotates through 90° counter-clockwise, as seen from the left in FIG. 1 in accordance with the showing of the arrows 2 in FIGS. 1 and 2, the tooth 20 will be lifted through the distance *e* and will simultaneously be rocked clockwise, as seen in FIG. 3, by the swash plate-like motion of the wheel 19. Thus the tooth will move from the position indicated (for the cylindrical portion of its top land) by reference character 21 through an intermediate position 21*b* to the position 21*c*. In the course of this motion, the arris 26 of the tooth will move from the position 26*a* to the position 26*c*, along a path indicated at 27 in the diagram of FIG. 3*a*. By this motion, the portion of the last arriving turn of thread overlying the tooth 20 will be lifted and shifted from the full line position indicated in FIG. 3 at 24 to the position 24*c*.

With rotation of the shaft 3 through a second 90°, the tooth moves from the position 21*c* to the position 21*d* while its arris moves from 26*c* to 26*d*. In the process the thread portion 24 resting on the cylindrical portion 21 of the top land of the tooth 20 is shifted in FIG. 3 from the location 24*c* to the location 24*d*. At this point the top land of the tooth is again substantially tangent to the outer surface of the drum, so that the turn portion 24 is again deposited on the periphery of the drum, but at a location 24*d* which is shifted axially toward the free, right-hand end of the drum by reference to the location 24 at which the turn was laid on. During the third quarter of the shaft revolution under consideration, the top land of the tooth passes inside the drum to shift the arris 26 from the location 26*d* to the location 26*e*. In the fourth quadrant of the cycle of rotation for the shaft 3 the tooth returns to its starting point. The cycle is then renewed with a newly laid down last turn. Since the section plane of FIG. 3 is, as seen in FIG. 2, inclined to the vertical, the tooth 20 under consideration in FIG. 3 reaches the radial and axial extremes of its motion slightly later than is indicated by the diagram of FIG. 3*a*. The error involved is however without significance to an understanding of the operation of the invention.

In the course of the cycle which has been described, not only the turn 24 last, i.e. most recently, laid down but also the previously laid down turns will be shifted to the right. The second last turn, and in particular the portion thereof at the peripheral position on the drum occupied by tooth 20, will have begun the cycle at the position 24*d* in FIG. 3. When therefore the tooth 20 rises, on the first quadrant of the cycle, this turn will be engaged by the oblique thrust surface 25 of the tooth and not by its cylindrical surface 21. Hence the second last turn will be shifted a smaller distance to the right, with little or no lifting thereof from the surface of the drum. It is to be noted that the newly arriving turn 24 is not laid down either on top of or contiguous to the previous turn 24*d*. Hence there occurs no interlocking or tangling of protruding fibers of successive turns, and the turns can be pulled off one by one.

By the axial motion of the second last turn from the position 24*d* in the direction of the coil 23 which is produced by the thrust surface 25, that coil itself is axially shifted to the right as indicated by the arrow 34 in FIG. 3. The turns of thread in this coil are then pulled off periodically for insertion of a weft into the loom shed, over the right-hand end of the drum 8 inside a balloon-limiting cone 36 and through a thread-eye 37 in a manner similar to that described in U.S. Pat. No. 3,411,548.

Figure 5:
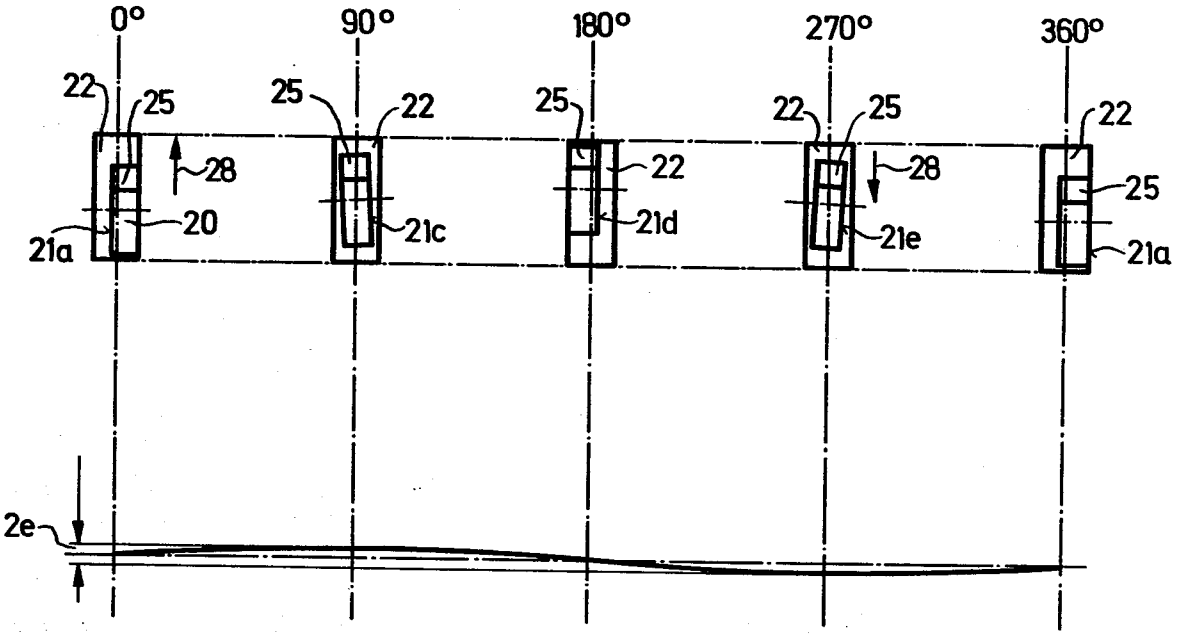
FIG. 5 is a diagram showing various positions of certain teeth of the toothed wheel with reference to the circumferentially distributed slots in the drum of the apparatus of FIG. 1.

FIG. 5 is a diagram showing, at four successive 90° phases of the cycle of rotation for shaft 3, the positions of a tooth on the wheel 19 with respect to the slot 22 of the drum engaged by that tooth.

The thread will be laid onto the drum either directly onto the surface 45 thereof, as indicated in FIG. 3, or onto the conical surface 42 of that figure, from whence it will slip onto the surface 45.

Figure 3B:
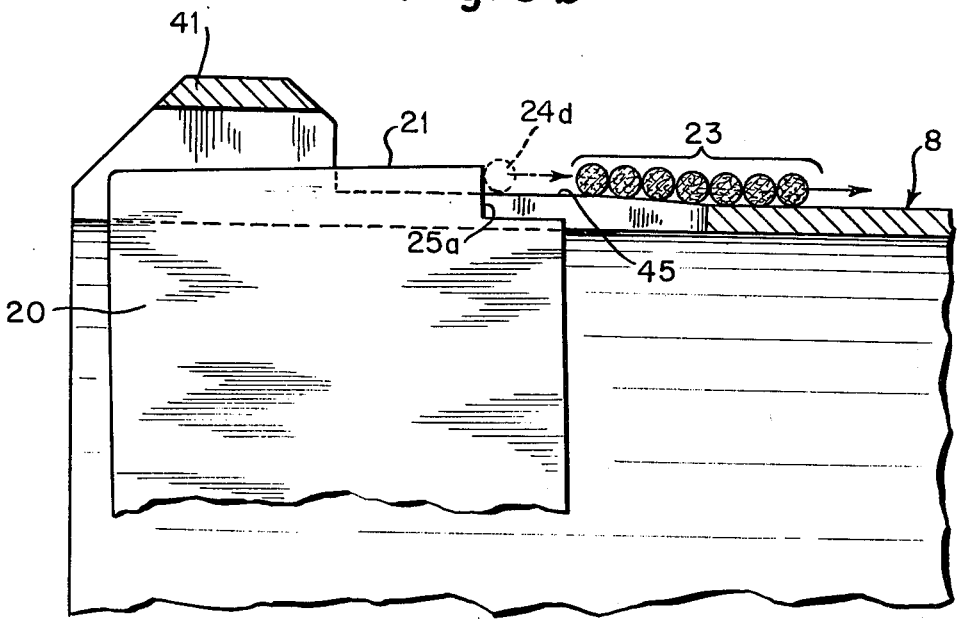
FIGS. 3*b* and 3*c* are views similar to FIG. 3 showing other shapes for the teeth of the toothed wheel.

In place of the inclined, oblique thrust surfaces 25 shown in full lines in FIGS. 1, 3, 4 and 5, the teeth may be provided with thrust surfaces at right angles to the cylindrical top lands, as indicated by the reference character 25*a* in FIG. 3*b*. The thrust surfaces of the teeth, whether inclined or perpendicular to the essentially cylindrical top land lifting surfaces thereof, extend in a direction having a component radial of the wheel 19, and therefore radial also of the drum itself. Since the angle of skew between the axes 13 and 17 is small, surfaces coaxial of the wheel 19, whether cylindrical or conical, are approximately coaxial of the drum.

Figure 3C:
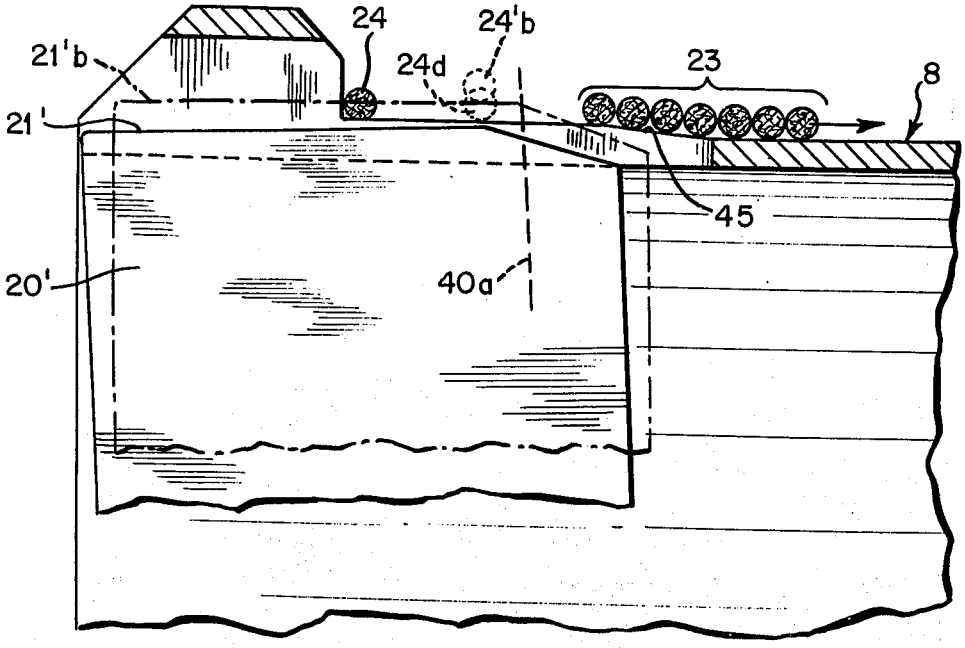

The construction may be such that the teeth will apply two or more successive lifting and shifting motions to the thread turns, instead of one lifting and shifting motion as in the example described, before those turns are passed on to the thrusting surfaces of the teeth. Thus the teeth may have a top land of substantially cylindrical shape extending for a tooth in the position 21*b*′ in FIG. 3*c*, all the way to the dash line 40*a*. With such a construction the last thread turn portion 24, being lifted and shifted from position 24 to position 24*d* on the first shaft cycle after its laying down, will be lifted off the drum again as shown at 24*b*′, axially shifted farther to the right, and laid down again, all on the next cycle, before being engaged on the third or on a later cycle by the thrust surfaces of the teeth.

The invention thus provides apparatus for the storage of filamentary material comprising a shaft 3 having a free end 6, a drum 8 having a plurality of axially extending slots 22 about its periphery, a wheel 19, bearings 7 and 18 mounting the wheel and drum on the free end 6 for rotation with respect to the shaft 3 about separate axes 17 and 13 which are skew to each other, whereby a filament 1 wound on the drum can be pulled off one end of the drum (the right end, in FIG. 3) over the free end of the shaft, and teeth 20 on the wheel engaging those slots, the teeth extending axially of the drum and terminating short of that one end of the drum, the teeth having each a thread lifting top land surface 21 extending substantially parallel to the axis of the drum and, at the axial end of the tooth adjacent that one end of the drum, a thread-thrusting surface 25, or 25*a* or 40*a*, extending in a direction including a component radial of the drum. The thread-thrusting surfaces of the teeth may conform substantially to portions of a common conical surface, as indicated at 25 in FIG. 3, or they may conform substantially to a common plane surface perpendicular to the axis of the wheel, as indicated at 25*a* or 40*a* in FIG. 3. The apparatus may include means to rotate the drum with respect to the shaft. Or the shaft may be a hollow rotatable shaft including a flyer arm 5 extending into exterior overlapping relation with the drum, the apparatus further including means such as the magnets 9 and 12 to restrain the drum against rotation.

More particularly, the apparatus may comprise a hollow rotatable shaft 3, a drum 8 having an exterior surface conforming substantially to a surface of revolution, bearings 7 supporting the drum from one end 6 of the shaft for rotation with respect to the shaft, a flyer arm 5 affixed to the shaft and extending radially and axially thereof into exterior overlapping relation with the surface of the drum, that exterior surface including a plurality of axially extending slots 22 disposed about the periphery thereof, magnets 9 and 12, or weights, restraining the drum against rotation whereby a filament 1 passed through the shaft and out onto the arm will be wound up on the drum upon rotation of the shaft and may be pulled off of the end of the drum remote from the arm, two-part bearing means 50 and 52 defining an axis 17 of relative rotation between the two parts of said bearing means, the part 50 being affixed to the shaft with the axis 17 skewed to the axis 13 of rotation of the shaft, and a wheel 19 affixed to the other part 52 of the bearing means, the wheel having teeth 20 on the periphery thereof engaging the slots 22 in the drum, the teeth having an axial length less than the length of said drum, the teeth extending axially of the drum and terminating short of that remote end of the drum, the teeth having each a thread-lifting top land surface 21 extending substantially parallel to the axis 13 of the drum and, at the axial end of the tooth adjacent that remote end of the drum, a thread-thrusting surface extending in a direction including a component radial of the drum.

Figure 6:
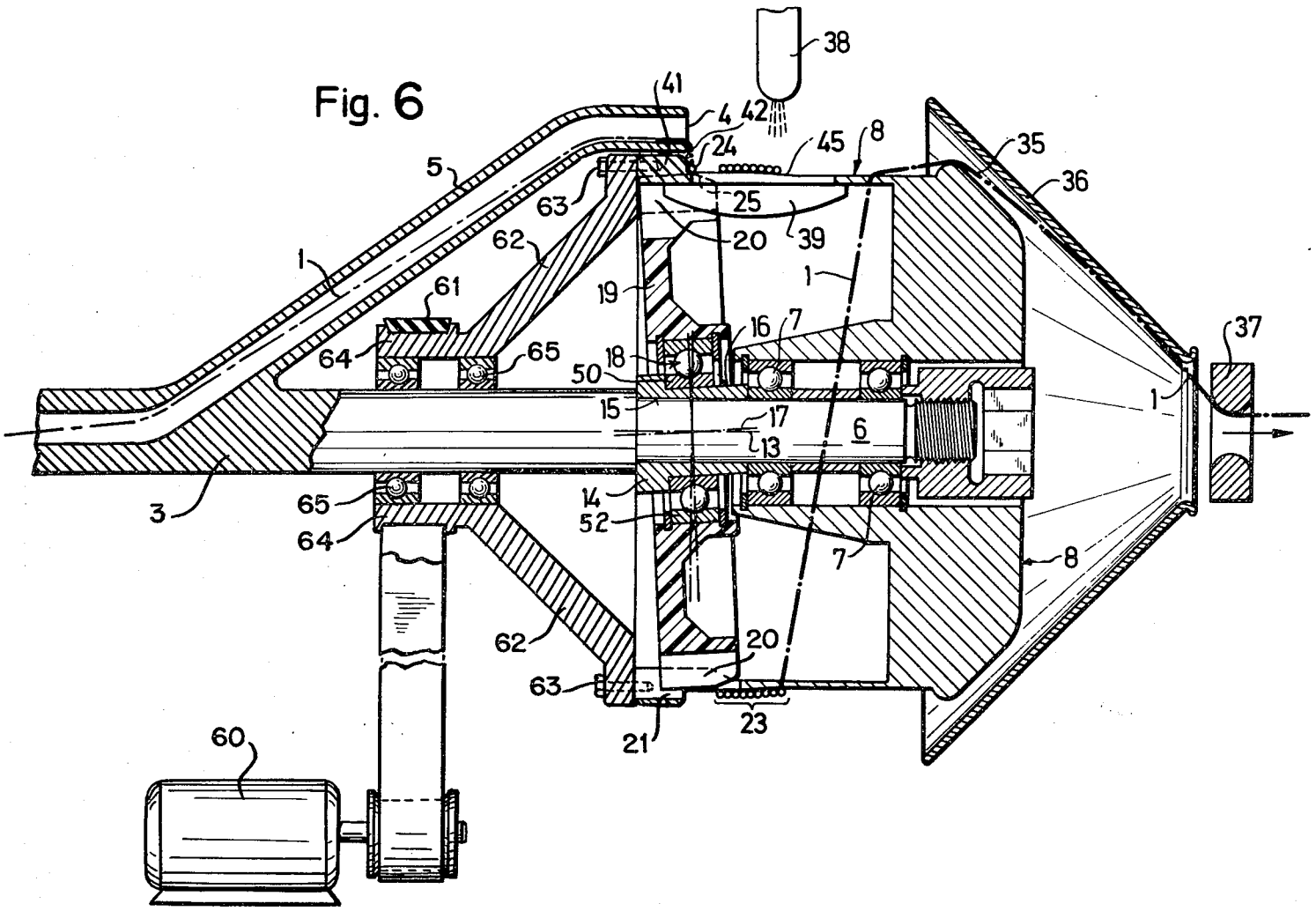
FIG. 6 is a vertical axial sectional view through a modified form of the thread storage apparatus in accordance with the invention.

While the invention has been described hereinabove in terms of a number of presently preferred embodiments thereof, the invention itself is not limited thereto. For example, the invention may find application in apparatus for the storage of filamentary material of the type shown in British Pat. No. 977,936 wherein the drum is caused to rotate with the thread being fed thereto from a stationary eye. As shown in FIG. 6, which illustrates such an embodiment of the invention, the structure of the thread storage device may be identical to that illustrated in FIGS. 1 to 5 except that the magnets are dispensed with and a frame member 62 is provided to rotatably support the end of the drum 8 adjacent the flyer arm 5 on shaft 3. One end of frame 62 is attached by screws 63 to the end of the drum 8 and the other end of the frame terminates in a sleeve 64 which is rotatably supported on the stationary shaft 3 by ball bearings 65. The drum is driven by motor 60 via belt 61 which passes over sleeve 64. As the drum rotates, the teeth on the wheel engage the slots in the drum and cause the wheel to rotate about sleeve 14 affixed to the shaft. The thread fed from the stationary flyer arm 5 is wound on the drum and the thread turns are advanced axially of the drum toward the free end of the shaft in the same manner as in the embodiment of the invention illustrated in FIGS. 1 to 5 heretofore described. In apparatus according to the invention of either type, the drum may be made up of a plurality of bars in the form of a squirrel cage or swift instead of the continuously surfaced drum which has been illustrated, and the term "surface of revolution" used in certain of the claims to describe the drum is to be understood as including such a combination of bars. Also by making the sleeve 14 movable with respect to the shaft 3 and by coupling the two together with a suitable drive having a drive ratio other than 1:1, the cyclical motion of the toothed wheel, illustrated in FIG. 3*a* for the embodiments described, may have a frequency different from the rate of rotation of the shaft.

More generally, the invention comprehends all modifications of and departures from the embodiments hereinabove described properly falling within the scope of the appended claims.

I claim:

1. Apparatus for the storage of filamentary material comprising a hollow shaft having a free end, a drum having an exterior surface conforming substantially to a surface of revolution, a wheel, means mounting the wheel and drum on the free end of the shaft for rotation with respect to the shaft about separate axes which are skew to each other, a flyer arm affixed to the shaft and extending radially and axially thereof into exterior overlapping relation with said surface of the drum adjacent the end thereof nearest the other end of the shaft, said exterior surface including, adjacent said end of the drum, a plurality of axially extending slots disposed about the periphery thereof, whereby upon rotation of the drum with respect to the shaft a filament passed through the shaft and out onto the arm will be laid in a helical coil on said surface adjacent said end of the drum and may be pulled off of the other end of the drum, and teeth on the wheel engaging the slots, the teeth having each a thread lifting top land surface extending substantially parallel to the axis of the wheel over a minor fraction of the length of the drum including however the portion of the drum length beneath the flyer arm, the teeth further having each a thread-thrusting surface extending in a direction includng a component radial of the wheel, whereby the top lands and thrusting surfaces engage only the portion of the coil nearest said end of the drum.

2. Apparatus according to claim 1 wherein said thread-thrusting surface conforms substantially to a portion of a conical surface.

3. Apparatus according to claim 1 wherein said thread-thrusting surface conforms substantially to a plane surface perpendicular to the axis of the wheel.

4. Apparatus according to claim 1 including means to rotate said drum with respect to said shaft.

5. Apparatus according to claim 1 wherein said shaft is a hollow rotatable shaft including a flyer arm extending into exterior overlapping relation with said drum, said apparatus further including means to restrain said drum against rotation.

6. Apparatus for the storage of a filament comprising a hollow rotatable shaft having a free end, a drum having an exterior surface conforming substantially to a surface of revolution, means supporting the drum from that end of the shaft for rotation with respect to the shaft, a flyer arm affixed to the shaft and extending radially and axially thereof into exterior overlapping relation with the surface of the drum adjacent the end thereof nearest the other end of the shaft, said exterior surface including, adjacent said end of the drum, a plurality of axially extending slots disposed about the periphery thereof, means restraining the drum against rotation whereby upon rotation of the shaft a filament passed through the shaft and out onto the arm will be laid in a helical coil on said surface adjacent said end of the drum and may be pulled off of the other end of the drum, two-part bearing means defining an axis of relative rotation between the two parts of the bearing means, one of said parts being affixed to the shaft with the axis of relative rotation skewed to the axis of rotation of the shaft, and a wheel affixed to the other part of said bearing means, the wheel having teeth on the periphery thereof engaging the slots in the drum, the teeth having each a thread lifting top land surface extending substantialy parallel to the axis of the wheel over a minor fraction of the length of the drum including however the portion of the drum length beneath the flyer arm, the teeth further having each a thread-thrusting surface extending in a direction including a component radial of the wheel, whereby the top lands and thrusting surfaces engage only the portion of the coil nearest the end of the drum.

7. Apparatus according to claim 6 wherein said thread-thrusting surface conforms substantially to a portion of a cone.

* * * * *